United States Patent [19]

Hilgers

[11] 4,354,607

[45] Oct. 19, 1982

[54] CRANE FOR HEAVY LIFTING WITH AN ERECTION COLUMN FOR THE MAIN JIB

[75] Inventor: Franz Hilgers, Düsseldorf, Fed. Rep. of Germany

[73] Assignee: Leo Gottwald KG, Düesseldorf-Reisholz, Fed. Rep. of Germany

[21] Appl. No.: 165,505

[22] Filed: Jul. 3, 1980

[30] Foreign Application Priority Data

Aug. 17, 1979 [DE] Fed. Rep. of Germany ..... 2933382

[51] Int. Cl.[3] ..... B66C 23/00

[52] U.S. Cl. ..... 212/175

[58] Field of Search ..... 212/175–181, 212/187, 188, 222

[56] References Cited

U.S. PATENT DOCUMENTS 3,082,746 3/1963 Kerridge ..... 212/222 X

FOREIGN PATENT DOCUMENTS 856598 11/1970 Canada ..... 212/178

*Primary Examiner*—Robert G. Sheridan

*Attorney, Agent, or Firm*—Toren, McGeady & Stanger

[57] ABSTRACT

A crane of the type having a slewing upper chassis 5 carrying a jib, the lowermost component of which is shown at 10, and an erection column 12 for raising the jib from a horizontal assembly position into an upright operating position, has a hydraulic cylinder 11 connected to the component 10 and a cable 13 connecting the component 10 to the column 12. The column 12 is raised from the lowered position shown to an upright position, in which subsequently a tackle 14 swings the column 12 rearwards and raises the jib to its upright operating position, by means of the cylinder 11. A better purchase can be obtained by the cylinder 11 acting on the component 10 than by a cylinder acting directly on the column 12 which is usual, and therefore a smaller cylinder can be used.

11 Claims, 6 Drawing Figures

CRANE FOR HEAVY LIFTING WITH AN ERECTION COLUMN FOR THE MAIN JIB

This invention relates to cranes especially heavy-lift cranes, comprising an upper chassis which is rotatable about a vertical axis, a main jib which is pivotally mounted on the chassis to pivot in a vertical plane, an erection column which is pivotally mounted to pivot in the same vertical plane as the jib, means for connecting the column to the jib so that the jib follows pivotal movement of the column in one direction, and a tackle acting between the column and the chassis for pivotally moving the column to enable the jib to be raised from an assembly position into an upright operative position.

Such cranes also have a lower chassis, which may be mobile, on which the upper chassis slews and a further jib is generally pivoted to the main jib which in operation then remains stationary. In the erected operating position, the main jib is usually vertical or slightly inclined from the vertical.

For raising the main jib from an assembly position and lowering it to this position, the erection column is provided. This is pivoted near the pivot of the main jib. Erection of the crane involves first bringing the lower component of the jib, which is pivoted on the upper chassis, into the assembly position, which is usually a substantially horizontal position. After the other components of the jib have been assembled with the lower component, the erection column is pivoted by means of hydraulic cylinders into an upright position, in which the jib and erection column form as favourable an angle as possible to each other for lifting the jib from the assembly position. Neck cables are then reeved for connecting the free ends of jib and erection column together. Following thereon, the erection column is then pivoted rearwardly away from the jib by means of a tackle leading from its free end to the upper chassis, taking the jib with it, sufficiently far for the jib to reach its operating position. The erection column and the neck cables then form a triangle with the jib, this triangle being held by the tackle against tilting forwards.

Tilting of the jib rearwards is prevented by reverse fall props extending between the jib and the upper chassis. These are installed after the jib has been raised. These props are equipped with a spring device which comes into action in the last phase of the raising operation.

The pivoting of the erection column into the upright position can lead to difficulties especially when, on account of the construction of the crane to lift heavy loads, this column has a correspondingly great weight. The hydraulic cylinders provided for this purpose may not then be adequate to swing the column.

The object of the present invention is so to construct a crane as initially described that the raising into its upright position of the erection column even when this has a heavy weight is possible without difficulty. This is moreover effected with a crane of relatively simple construction.

To this end, according to this invention, in a crane as initially described the jib has a lower component which is pivoted to the chassis and which has a pivoting drive which acts directly on the lower component to enable the lower component to be moved pivotally before remaining parts of the jib are assembled, and means are provided for connecting the lower component to the column, whereby, to assemble the jib, the lower component is moved by its drive into a raised position, is connected to the column, which is lowered and directed away from the lower component, by the connecting means and is then moved in a direction away from the column into an assembly position and moves the column with it causing the column to be raised into an upright position.

The erection column is thus no longer moved directly by hydraulic cylinders but is moved through the intermediary of the lower component of the jib which in turn is moved by its own pivoting drive. Initially the lower component of the jib is brought by its pivoting drive into a position in which it makes the same angle with the erection column as in the assembly position just before raising of the jib as a whole. The lower component and the erection column are then connected together and are pivoted together by means of the pivoting drive acting upon the lower component, until the component is situated in the assembly position. The erection column then automatically adopts an upright position and is held in this position by the tackle. The other parts of the jib can then be assembled with the lower component, and the neck cables for connecting the jib and the erection column can be reeved.

By the intermediate incorporation of the lower component of the jib, substantially more favourable torque conditions are obtained for the raising of the erection column, so that the raising even of a heavy erection column is possible without an exceptionally powerful pivoting drive.

In one embodiment of the invention, a cable is provided for connecting the lower component of the jib to the erection column since such a cable can be easily installed. The cable is preferably attached to the free ends of the erection column and of the lower component of the jib, in order to obtain favourable force relationships.

According to a further preferred feature of the invention, the lower component of the jib forms only a foot of the jib. In the usual case the height of the foot is sufficient to make possible the raising of the erection column by lever action.

In a further embodiment of the invention the pivoting drive is formed as a hydraulic cylinder. This is preferably a two-stage cylinder on account of the large pivoting angle necessary. A plurality of such hydraulic cylinders can, of course, also be used. It is preferred to arrange the hydraulic cylinder on the rear side of the jib, that is the side at which the erection column is situated.

Preferably, the pivoting drive is constructed so that it constitutes a reverse fall prop when the jib is in its operating position. The pivoting drive is thus accorded a dual function, namely firstly for effecting the pivoting of the lower component of the jib for raising the erection column, and secondly for replacing the hitherto usual reverse fall props. In this manner the construction is simplified.

The pivoting drive may have mechanical stops for locating the jib in the operating position, in order to avoid tilting backwards of the jib. When the drive is constructed as a hydraulic cylinder, this mechanical stop may be formed as a sleeve fitted over the piston rod parts of the hydraulic cylinder. The sleeve bears against the cylinder casing of the hydraulic cylinder when the jib is in its operating position.

Moreover, it is of advantage if, according to a further preferred feature of the invention, in the last stage of raising the jib to its operating position, a hydraulic counter-pressure is generated in the hydraulic cylinder, in order to achieve in this way a spring action. Finally, it is preferred for the erection column to be pivoted on the lower component of the jib.

An example of a crane in accordance with the invention is illustrated in the accompanying diagrammatic drawings in which.

Figure 1:
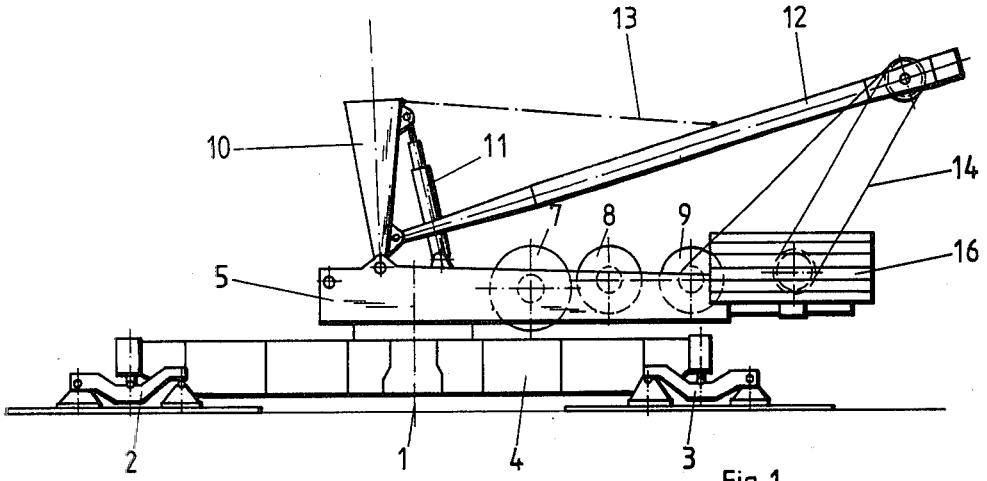
FIG. 1 is a side view of part of the crane showing the lower part of the jib and the erection column.

FIG. 1 is a side view of the crane which is not yet fully assembled. The crane comprises a lower chassis 4 supported on the ground through feet 2 and 3, and an upper chassis 4 which is mounted to slew on the lower chassis about a vertical axis 1. The upper chassis 5 has at its rear a cantilever counter-weight 16 and three cable drums 7, 8, 9, which are driven by a motor, which is not shown.

Just forward of the slewing axis 1 of the upper chassis 5, a lower jib component 10 is pivotally mounted on the chassis 5. The component 10 can be pivoted in a vertical plane by means of a two-stage hydraulic cylinder 11, connected to the upper chassis 5.

Near the foot of the jib component 10, an erection column 12 is pivotally mounted on the component 10 and extends rearwardly therefrom.

The erection column 12 is also attached to the jib component 10 by a cable 13, extending between the upper end of the lower jib component 10 and approximately the centre of the erection column 12. From the rearward end of the erection column 12, a tackle 14 extends to the upper chassis 5, the running end of the cable of this tackle being wound on the right hand winch drum 9.

FIGS. 2 to 6 show how a raising procedure for the jib is carried out.

Figure 2:
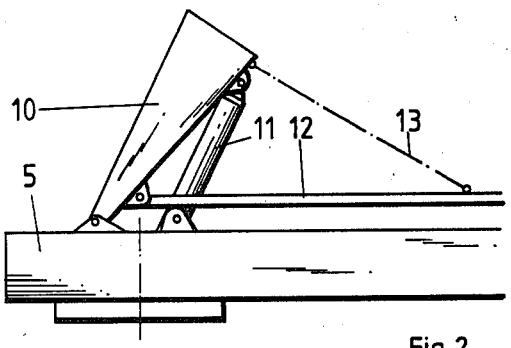
FIG. 2 is a side view to a slightly larger scale showing part of the crane shown in FIG. 1, with the erection column in a rest position.
Figure 3:
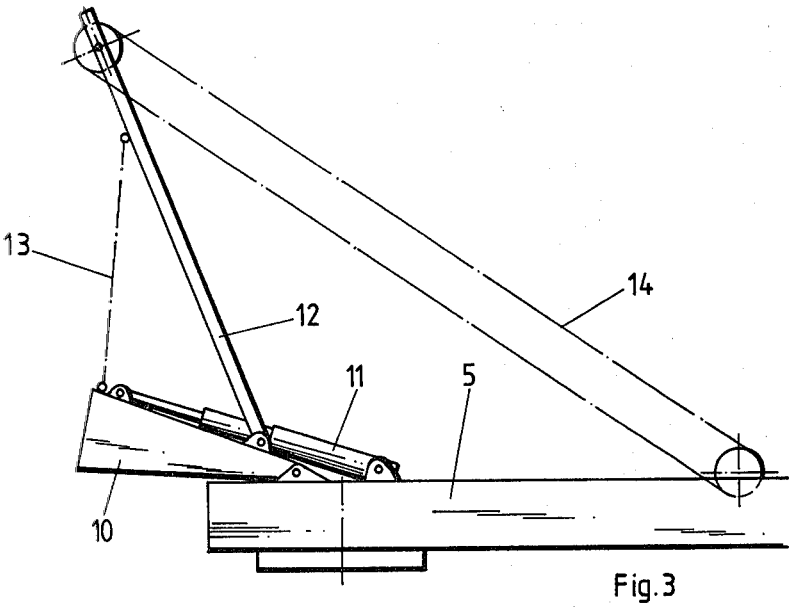
FIG. 3 is a view similar to FIG. 2 but with the erection column in a raised position.

In FIG. 2, the erection column 12 is in a rest position, that is a horizontal position. The lower jib component 10 is moved by means of the hydraulic cylinder 11 into such an angular position relative to the erection column 12 that the cable 13 is taut. To raise the erection column 12, the hydraulic cylinder 11 is extended so that the lower jib component 10 is turned counter-clockwise and moves the erection column 12 with it until they have both adopted the positions shown in FIG. 3. During this movement the tackle 14 is slacked off. In this position the erection column 12 is more or less upright, while the lower jib part 10 has nearly reached an assembly position.

Figure 4:
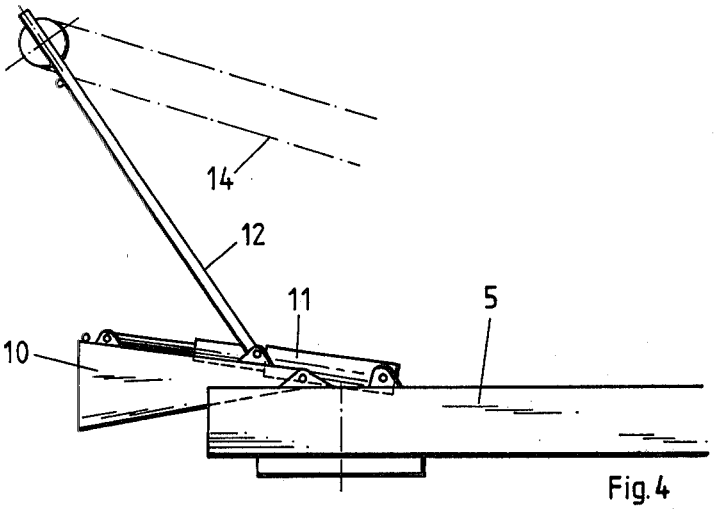
FIG. 4 is a view similar to FIG. 2 but showing the lower part of the jib in an assembly position.

The cable 13 is now released, so that the erection column 12 is held only by the tackle 14. The lower jib component 10 is then brought into a horizontal assembly position, as shown in FIG. 4. When in this horizontal position, the other parts 15 of the jib are bolted on to the lower component 10. When this has been done, so-called neck cables are connected between the upper end of the jib part 15 and the erection column 12, so that the column 12 and the jib are again connected together.

Figure 5:
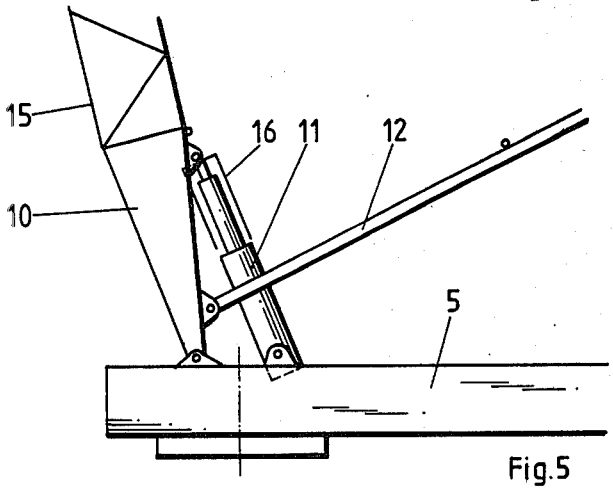
FIG. 5 is a view similar to FIG. 2 but showing the jib and the erection column in operating positions; and, FIG. 6 is a view similar to FIG. 2, but showing the jib in a counter position.

Following this, the jib 15 is then raised as shown in FIG. 5. This is done by pulling on the tackle 14, so that the erection column 12 is swung rearwardly in a clockwise direction. The jib 15 follows this movement owing to the neck cables which are not shown. In FIG. 5 the jib has nearly reaches a vertical operating position, while the erection column 12 is directed obliquely rearwards. The jib 10, 15 could not be raised from the assembly position shown in FIG. 4 by the cylinder 11, because in this position, the cylinder 11 has no moment arm about the pivot axis of the jib component 10.

As shown in FIG. 5, the hydraulic cylinder 11 may have a sleeve 16, which extends over the piston rod parts. This sleeve forms with the cylinder casing a mechanical stop, so that the jib 15 cannot swing rearwards beyond its highest operating position. In the absence of the sleeve 16, a counter-pressure can be generated by the hydraulic cylinder 11, counteracting further pivoting of the jib 15 beyond top dead centre.

Figure 6:
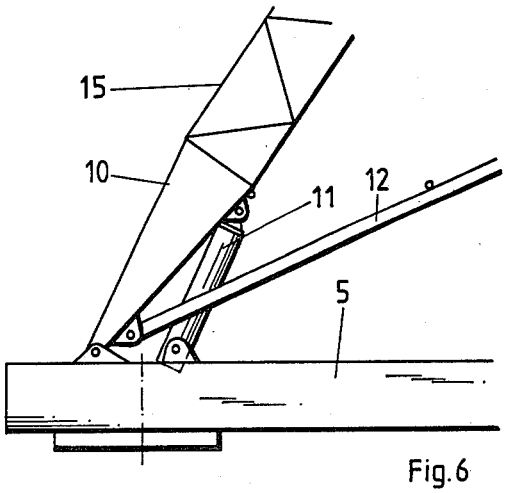

If the jib 15 is to operate as a counter-jib inclined towards the rear, then the hydraulic cylinder 11 is constructed so that it can be retracted still further, as shown in FIG. 6. It then forms a reverse fall prop, so that no separate props are necessary for this purpose.

I claim:

1. In a crane comprising an upper chassis, means mounting said upper chassis for rotatable slewing movement about a vertical axis, a main jib, means pivotally mounting said main jib on said chassis for pivotal movement in a vertical plane, an erection column, means pivotally mounting said erection column for pivotal movement in said vertical plane, means for connecting said column to said jib whereby said jib follows pivotal movement of said column in one direction, and tackle means acting between said column and said chassis for pivotally moving said column to raise said jib from an assembly position into an upright operative position, the improvement wherein said jib includes a lower component, means pivotally mounting said lower component on said chassis, means for connecting said lower component to said column and pivoting drive means acting directly on said lower component to enable said lower component to be moved pivotally before remaining parts of said jib are assembled, whereby, to assemble said jib, said lower component is moved by said pivoting drive means into a raised position, said lower component is connected by said connecting means to said column, which is lowered and directed away from said lower component, and said lower component is then moved by said pivoting drive means in a direction away from said column into said assembly position and moves said column with it, causing said column to be raised into an upright position.

2. A crane as claimed in claim 1, in which said means for connecting said lower component to said column is a cable.

3. A crane as claimed in claim 2, further comprising means attaching said cable to a free end of said column and means attaching said cable to a free end of said lower component.

4. A crane as claimed in claim 1, in which said lower component is formed by jib foot means.

5. A crane as claimed in claim 1, in which said pivoting drive means includes a hydraulic cylinder, means pivotally connecting said hydraulic cylinder to said lower component and means pivotally connecting said hydraulic cylinder to said chassis.

6. A crane as claimed in claim 5, in which said cylinder is a two-stage cylinder.

7. A crane as claimed in claim 5, in which said hydraulic cylinder is disposed at the rear side of said jib.

8. A crane as claimed in claim 5, in which said pivoting drive means includes means forming a reverse fall prop to prop said jib against rearward falling when said jib is in said operating position.

9. A crane as claimed in claim 8, in which said means for forming a reverse fall prop comprises mechanical stop means to locate said jib in said operating position.

10. A crane as claimed in claim 9, in which said mechanical stop means includes a sleeve fitted over piston rod parts of said hydraulic cylinder, said sleeve bearing against said cylinder when said jib is in said operating position.

11. A crane as claimed in claim 1, in which said erection column is pivotally mounted on said lower component.

* * * * *